US009095008B1

(12) United States Patent
Seacord et al.

(10) Patent No.: US 9,095,008 B1
(45) Date of Patent: Jul. 28, 2015

(54) HEATED BLANKET

(71) Applicants: Michael P. Seacord, Davisburg, MI (US); Dennis J. Martinich, Grand Ledge, MI (US)

(72) Inventors: Michael P. Seacord, Davisburg, MI (US); Dennis J. Martinich, Grand Ledge, MI (US)

( * ) Notice: Subject to any disclaimer, the term of this patent is extended or adjusted under 35 U.S.C. 154(b) by 81 days.

(21) Appl. No.: 13/657,769

(22) Filed: Oct. 22, 2012

Related U.S. Application Data

(60) Provisional application No. 61/549,415, filed on Oct. 20, 2011.

(51) Int. Cl.
*H05B 1/02* (2006.01)
*H05B 3/34* (2006.01)

(52) U.S. Cl.
CPC ..... *H05B 3/34* (2013.01); *H05B 1/0202* (2013.01)

(58) Field of Classification Search
CPC ..... H05B 3/34; H05B 3/36; H05B 3/12; H05B 3/146; H05B 1/0202; H05B 1/0244; H05B 1/0272; H05B 3/0085
USPC ..... 219/481, 494, 212, 504, 505; 5/412; 2/83, 905
See application file for complete search history.

(56) References Cited

U.S. PATENT DOCUMENTS

| | | | | |
|---|---|---|---|---|
| 4,044,221 | A * | 8/1977 | Kuhn | 219/217 |
| 4,250,397 | A * | 2/1981 | Gray et al. | 392/435 |
| 4,967,057 | A * | 10/1990 | Bayless et al. | 219/213 |
| 6,486,452 | B2 * | 11/2002 | Loyd et al. | 219/530 |
| 6,933,469 | B2 * | 8/2005 | Ellis et al. | 219/217 |
| 7,781,706 | B2 * | 8/2010 | Park | 219/528 |
| 8,399,814 | B2 * | 3/2013 | Stepanian | 219/544 |
| 2002/0003136 | A1 * | 1/2002 | Williamson et al. | 219/212 |
| 2007/0272673 | A1 * | 11/2007 | Keane | 219/212 |
| 2012/0312797 | A1 * | 12/2012 | Augustine et al. | 219/212 |

* cited by examiner

*Primary Examiner* — Mark Paschall

(74) *Attorney, Agent, or Firm* — L.C. Begin & Associates, PLLC.

(57) ABSTRACT

A heated blanket is presented that includes a heat mesh contained therein for uniform heating of the heated blanket. Also presented is a system for heating an article including the aforementioned heated blanket and an optional thermostat for measuring the temperature of an article to be heated. As the temperature of the article departs from a preset temperature range, the thermostat controls power to the heated blanket thereby either completing or interrupting the electrical supply to the heated blanket depending on whether the article must be cooled or warmed.

18 Claims, 2 Drawing Sheets

HEATED BLANKET

CROSS-REFERENCE TO RELATED APPLICATIONS

This application claims the benefit of U.S. Provisional Application Ser. No. 61/549,415 having a filing date of Oct. 20, 2011.

BACKGROUND

A heated blanket is presented for use in industrial applications such as the automotive, chemical, or other industrial settings. Oftentimes, bulk fluids or chemicals are stored in 55-gallon drums, 400 gallon totes, or in other conventionally-sized containers whereby the applicability, the consistency, and/or the efficacy of the fluid may be compromised as it cools below temperatures normally recommended for its use. In particular, although not thereby limited, an exemplary use of the present blanket is for the maintenance of a residual temperature of chemicals typically stored perhaps outside, in warehouses, or in other areas where the storage area is not necessarily heated.

Accordingly, the blanket is contemplated for use in a wrap-around configuration for example. As such, a 55-gallon drum of chemical such as a polymeric blend, or an oil-based fluid might include a heated blanket secured about its periphery. In this way, the temperature may be maintained at a predetermined temperature or temperature range as per the manufacturer's recommendations, or at a temperature that does not compromise the safe handling or storage of the bulk fluid or chemical. Other uses for the present blanket are also contemplated and include ground thawing applications, concrete curing applications, material curing applications, work mats, and so forth.

Certain challenges exist with the current state-of-the-art heated blankets. For example, ensuring safe heating of the blanket with the heating element is one concern. Secondly, ensuring substantially uniform heating across the surface of the heating blanket is yet another concern. Additionally, ensuring that the heated blanket is properly controlled to ensure heating within the desired range is yet another challenge.

SUMMARY OF THE INVENTION

A heated blanket is presented that includes a heat mesh contained therein for uniform heating of the heated blanket. Also presented is a system for heating an article including the aforementioned heated blanket and an optional thermostat for measuring the temperature of an article to be heated. As the temperature of the article departs from a preset temperature range, the thermostat controls power to the heated blanket thereby either completing or interrupting the electrical supply to the heated blanket depending on whether the article must be cooled or warmed.

Stated another way, the invention may be described as a heating system containing a blanket for heating an article; a first outer panel of the blanket defining an area having a first region or corner, a second region or corner, a third region or corner, and a fourth region or corner; a heating element of the blanket proximate to or adjacent to the first outer panel and substantially coextensive with the area defined by the first outer panel, said heating element fixed to the first outer panel on at least one of the first, second, third, and fourth corners; a power source in electronic communication with the heating element; a second outer panel of the blanket adjacent to the heating element and substantially coextensive with the area defined by the first outer panel, the second outer panel joined to the first outer panel; and a thermostat in thermal communication with an article to be heated by the blanket, the first thermostat in electronic communication with the power supply.

DETAILED DESCRIPTION OF THE INVENTION

Figure 1:
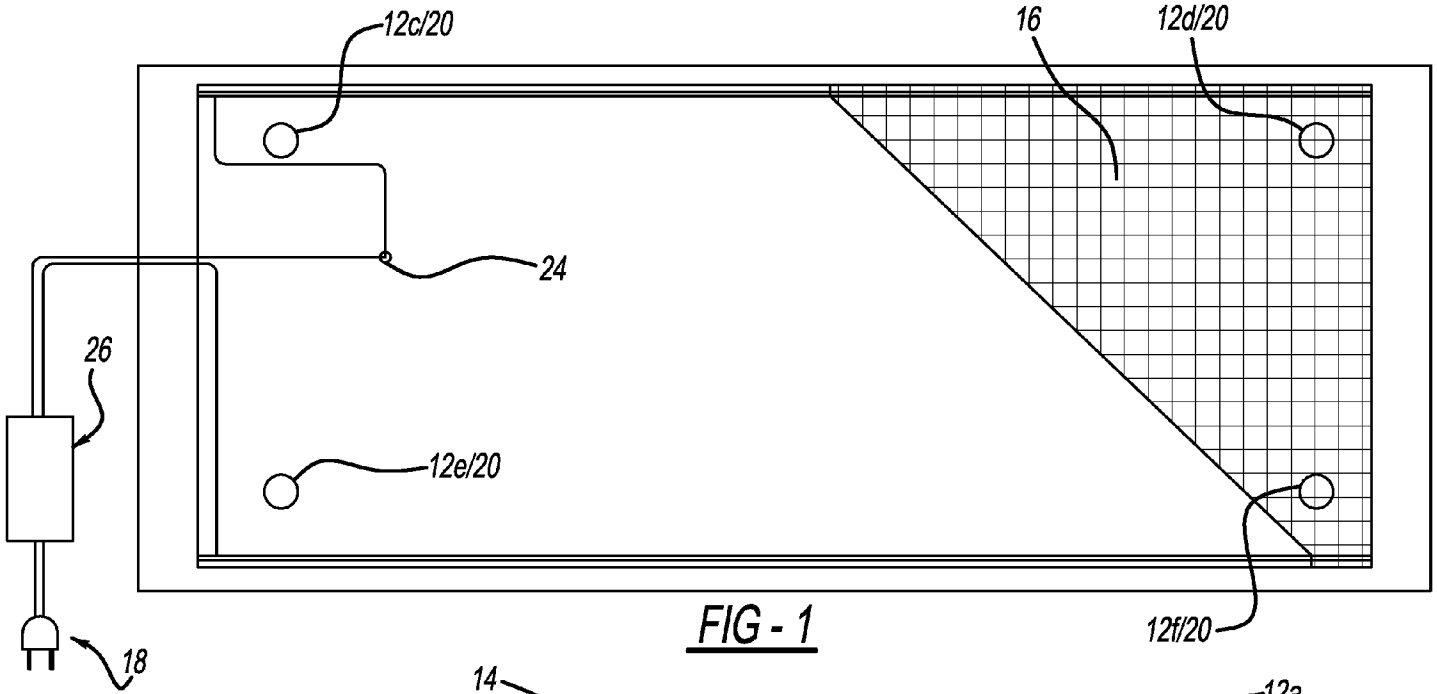
FIG. 1 is a schematic view of a blanket formed in accordance with the present invention.
Figure 2:
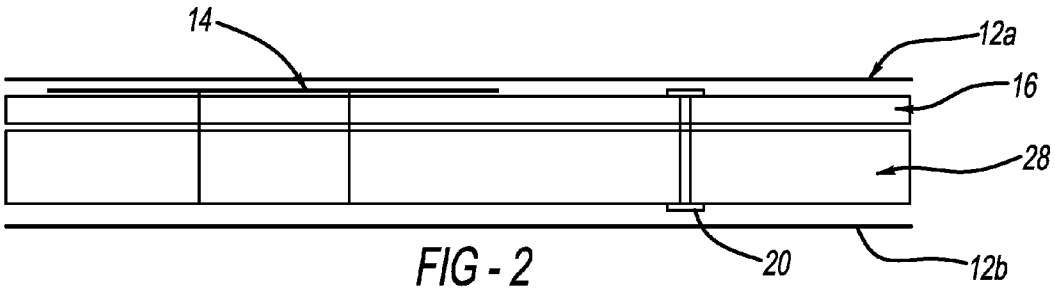
FIG. 2 is a cross-section of FIG. 1.

A heating system 10 contains a heatable blanket 11 as shown in FIG. 1. The blanket 11 includes a cover or casing 12 that includes an outer panel 12*a* and an inner panel 12*b*, and may if desired be weather resistant (e.g. waterproof), and/or heat and/or fire resistant (e.g. made from a fire retardant material), for example. A cross-section of FIG. 1 is presented as FIG. 2. The cover 12 may be formed from vinyl, silicone cloth, fiberglass cloth, or from trade materials known as Cordura® or Kevlar®, for example. The particular application will determine the cover 12 material, as will be appreciated by one of ordinary skill in the art. As shown in the FIGURES, an exemplary blanket 11 includes a first outer panel or layer 12 containing a material such as vinyl, or any other suitable covering for the blanket 11. The first outer panel 12 surrounds and preferably seals most of the other constituents of the blanket 11, and thereby functions as a housing. A second layer 14 may be provided and may be juxtaposed to the first outer layer 12 and formed from a foil material such as an adhesive foil pad. The foil material 14 forms an insulating barrier between the first layer 12 and other layers described below.

A third layer 16 may be juxtaposed to the second layer 14 and is radially inward therefrom, whereby the second layer 14 is sandwiched between the first layer 12 and the third layer 16. In an alternative embodiment, the third layer 16 may be "proximate" to the first outer layer 12, in the event the second layer 14 is not utilized. When used in this context, the term "proximate" is meant to denote and convey that the third layer 16 is either immediately adjacent (juxtaposed) to outer layer 12, or, that it is near but perhaps not immediately adjacent to layer 12. For example, layer 14 may be sandwiched between layers 12 and 16 and layer 16 may still be described as being "proximate" to layer 12. The third layer 16 is a conductive and/or radiating heating material that emanates heat as electricity is passed therethrough. An exemplary material useful as the third layer/heating element 16 may be a mesh or weave formed from a lattice of carbon conductor covered with a polymeric but heat conducting material. Unlike many heating elements, during operation, the mesh 16 thereby provides uniform heating across the area of the mesh. The third layer 16 may be purchased for example as a product known as "heat net" from Space Int., Ltd. of Kanseok Dong, South Korea. The heating element 16 may also be purchased for example, from Centech Co., Ltd of Hwaseong-si in South Korea. U.S. Pat. No. 7,781,706 is instructive, and is hereby incorporated by reference as if fully stated. An electrical power source 18 is configured with the third layer/heating mesh 16 in a known manner to provide power throughout carbon conductors of the heat mesh. As shown in FIG. 1, the electrical source is an AC source of 120 VAC, but other sources such as an AC source of 240 VAC, or a battery source having 12/24 VDC may also be employed, as will be appreciated by one of ordinary skill in the art. The mesh or third layer 16 may be generally formed from a carbon yarn or carbon thread conductor that is encased with a polymer such as silicone. Or, the mesh layer 16 may alternatively be formed as some other carbon composite conductor encased within a polymer such as silicone. It will be appreciated that the silicone/polymer will have a predetermined thermo-conductivity that may be iteratively determined based on the power applied and based on the type of polymer encasement, and also based on the thickness of the polymeric substrate.

Ultimately, the mesh 16 is fixed across a substantial area of the blanket 11 to co-extend across the area 12*c* defined by either the front panel 12*a* or the inner panel 12*b*, but internally of the blanket 11. A fixing means or fastener 20 fixes the mesh 16 to span across the area of the blanket 11 by providing a plurality of attachment zones at various locations of the heat mesh 16. Migration or general movement of the mesh 16 during use of the blanket 11 is thereby prevented or substantially prevented to ensure a c9ontinual uniform heating across the area of the blanket. The fixing means 20 may be a plurality of fasteners 20 such as heat-resistant fasteners that extend through panel 12*a* through the mesh 16 and ultimately through panel 12*b* wherein the mesh is then secured in place in a known way, such as by shank rivets, lock and key fasteners, button fasteners, bayonet fasteners, and other known suitable fasteners. Alternatively, another fixing means 20 may simply be a plurality of stitches, where each attachment zone is defined by a stitching that extends through the interstitial area of the mesh 16 and then attaches/sews the mesh 16 to panel 12*a* and/or 12*b*. The plurality of attachment zones that define the fixing means 20 may preferably be configured to support the mesh at least at a top left area or corner 12*c* and top right area or corner 12*d*, and at least at a bottom left area or corner 12*e* and a bottom right area or corner 12*f*. Accordingly, when the term "corner" is used herein, it refers to a general area proximate to the actual corner of the blanket. Yet another alternative to the fixing means 20 may simply be an adhesive backing applied to the mesh 16 that then fixes the mesh on the foil layer 14, again across the surface area 12*c* defined by 12*a* or 12*b*. It will be appreciated that any fixing means 20 may be employed that retains the mesh in a position that is substantially co-extensive with the area of the blanket 11 as defined by panel 12*a* or panel 12*b*.

Figure 3:
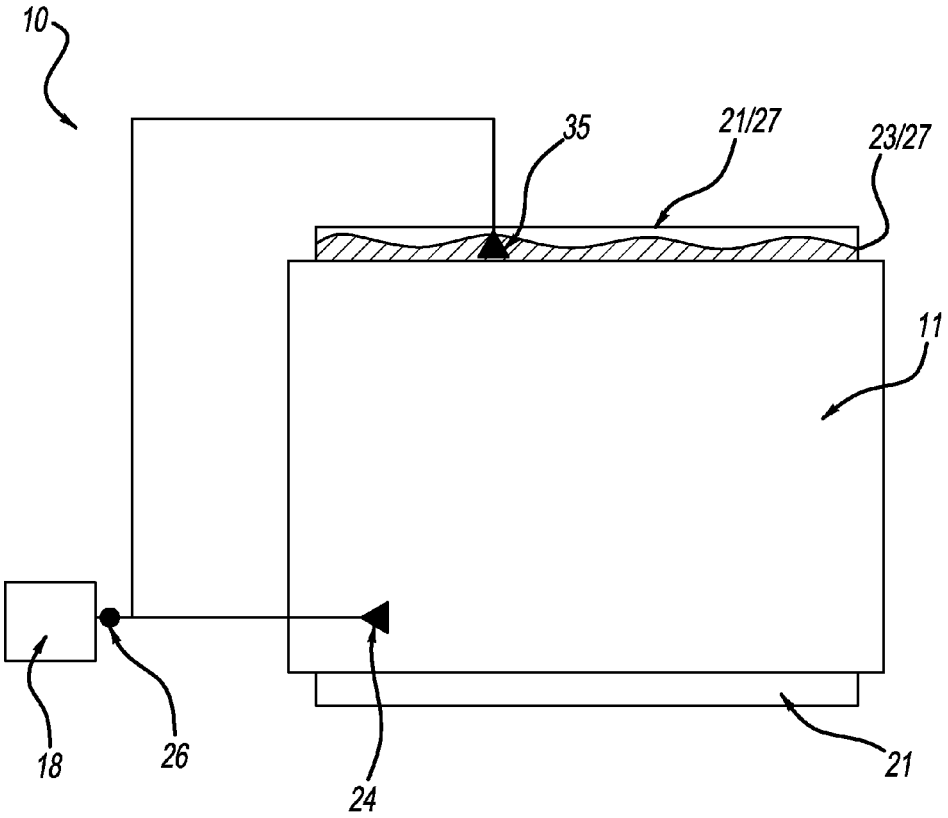
FIG. 3 is a schematic diagram of a blanket interfacing with a storage vessel for a desired chemical, wherein control of the bulk fluid temperature is illustrated.

As shown in FIGS. 1 and 3, a first thermostat 24 preferably electronically communicates with the electrical supply and the interior of the blanket 11, thereby controlling the temperature of the blanket 11 responsive to other control parameters described below or as otherwise known. One control parameter may be the surface of a container 21 to be warmed and temperature-controlled for example. Accordingly, the thermostat 24 is configured in a known manner to measure the temperature of the surface of the container or some other appropriate control surface and to switch on the electrical power supplied to the heat mesh grid 16 once the temperature is reduced below a preset temperature range.

A second optional thermostat 25 including a temperature sensor (not shown) may be included wherein the second thermostat may be submerged within a fluid 23 contained within the container 21. Stated another way, the second thermostat may thermally communicate with an article 27 such as container 21 and/or fluid 23 to be heated. Other "articles" that may be heated include concrete, floors, or work mats for example. As the fluid temperature fluctuates, either colder or hotter, the thermostat 25 by and through its sensing means may then, based on a preset temperature range for example, electronically communicate with the power supply in a known way, to complete or interrupt the power supply to the blanket 11, thereby providing a secondary heat control of a blanket heating system 10 in accordance with the present invention.

Stated another way, the blanket 11 is adapted to thermally respond to a thermostat 25 in thermal communication with an article 27 to be heated. It will be appreciated that the temperature of the blanket controlled by the first thermostat 24 may be markedly different than the temperature of the bulk fluid or substrate that may optionally be controlled by the second thermostat 25. For example, it may be necessary to heat the blanket to a relatively greater temperature to provide the necessary heat transfer to the fluid 23, thereby controlling the fluid at a relatively lower temperature. Probe immersion thermostats providing sensor temperature control may be provided by companies such as DeVale Industries of Buford, Ga., United States of America. Certain probe immersion thermostats provided by DeVale for example, are thermally sensitive bi-metallic switch assemblies that provide reliable control of fluids and air.

An in-line ground fault circuit interrupter (GFCI) 26 may be employed as a safety precaution and to ensure that the risk of electrical shock is mitigated or eliminated. As shown in FIG. 1, the GFCI may be simply hard-wired or connected to the power supply 18 and to the blanket 11, thereby interrupting electrical power in the event of a hazardous condition such as a wetting of the blanket 11 for example.

A fourth layer 28 may be provided and contains an EVA foam insulation layer 28 that provides a cushion about the vessel to be wrapped, and also provides an insulation to save power needed to heat the bulk fluid contained within an associated vessel 21, shown in FIG. 3. Again, other substrates or materials to be heated may include concrete, batteries, and other areas exposed to relatively cold conditions.

Finally, the inner panel 12*b* covers the foam layer 28 and is attached to the outer panel 12*a* by stitching or heat sealing inner panel 12*b* to the outer panel 12*a*, thereby providing a sealed blanket 11. Other sealing means may be employed if desired. Ultimately, a blanket 11 is provided that exhibits uniform heating across its area in a manner heretofore not realized.

The outer panel 12*a* may contain straps or other restraining means (not shown) that may be used to strap the blanket 11 about the vessel (not shown). It will be appreciated that as known in the art, the blanket may be sized and shaped to accommodate a myriad of shapes of vessels. Alternatively, the outer panel 12*a* may contain grommets or other fasteners that may be used to secure or tie down the blanket 11 on substrates such as concrete, for example.

In sum, the present invention may be basically stated as being, a heatable blanket containing a first cover panel 12*a*; a second layer/foil layer 14 adjacent/juxtaposed to the first cover panel 12*a*; a heating/conducting element 16 adjacent/juxtaposed to the second layer 14 and fixed across and substantially co-extensive with the area defined by the first cover panel 12*a*; a power source 18 electronically communicating with the heating element 16; and a second cover panel 12*b* attached to the first cover panel 12*a*. The constituents or components of the present invention are off-the-shelf items and may be supplied by known manufacturers. Various references that teach related items may be described in U.S. Pat. Nos. 5,931,343, 3,668,367, 7,880,121, and 7,851,729, wherein the teachings of each reference are herein incorporated by reference as if fully stated.

It will be appreciated that the various embodiments and features described herein are merely illustrative and exemplary, and are not meant to limit the invention. As such, the invention should be given full breadth consistent with the range of equivalents that may be found relative to each constituent, consistent with the appended claims.

What is claimed is:

1. A blanket comprising:

a first outer panel defining an area;

a heating element proximate to said first outer panel and substantially coextensive with the area defined by the first outer panel, said heating element formed as a mesh grid and containing carbon encapsulated within a polymer;

a power source in electronic communication with said heating element; and a second outer panel adjacent to said heating element and substantially coextensive with the area defined by the first outer panel, and joined to said first outer panel.

2. The blanket of claim 1 wherein said first outer panel contains four corners, and said heating element is fixed to each of said four corners.

3. The blanket of claim 1 further comprising a ground fault circuit interruption hard-wired to said power source.

4. The blanket of claim 1 further comprising an insulating layer between said heating element and said second outer panel.

5. The blanket of claim 1 wherein said heating element is a mesh grid containing carbon and silicone.

6. The blanket of claim 1 further comprising a thermostat for controlling the temperature of the blanket.

7. The blanket of claim 1 further comprising a foil layer sandwiched between said first outer panel and said heating element, said foil layer immediately adjacent said first outer panel and said heating element.

8. A heating system comprising:

a blanket for heating an article;

a first outer panel of said blanket defining an area having a first corner, a second corner, a third corner, and a fourth corner;

a heating element of said blanket proximate to said first outer panel and substantially coextensive with the area defined by the first outer panel, said heating element fixed to said first outer panel on each of said first, second, third, and fourth corners;

a foil layer sandwiched between said first outer panel and said heating element, said foil layer immediately adjacent said first outer panel and said heating element;

a power source in electronic communication with said heating element;

a second outer panel of said blanket adjacent to said heating element and substantially coextensive with the area defined by the first outer panel, and joined to said first outer panel; and a first thermostat in thermal communication with an article to be heated by said blanket and said first thermostat in electronic communication with said power supply.

9. The system of claim 8 further comprising a second thermostat in thermal communication with said blanket and in electronic communication with said power supply for controlling the temperature of said blanket.

10. The system of claim 8 further comprising one or more fasteners wherein each of said fasteners secures said heating element to said first cover at a corresponding one or more of said corners.

11. The system of claim 10 comprising two or more fasteners.

12. A blanket comprising:

a first outer panel defining an area having a first region, a second region, a third region, and a fourth region;

a heating element proximate to said first cover and substantially coextensive with the area defined by the first outer panel, said heating element fixed to said first outer panel on at least one of said first, second, third, and fourth regions, said heating element formed as a mesh grid and containing carbon encapsulated within a polymer;

a power source in electronic communication with said heating element; and a second outer panel adjacent to said heating element and substantially coextensive with the area defined by the first outer panel, and joined to said first outer panel.

13. The blanket of claim 12 further comprising a thermostat in thermal communication with the blanket for controlling the temperature of the blanket.

14. The blanket of claim 12 further comprising a foil layer sandwiched between said first outer panel and said heating element, said foil layer immediately adjacent said first outer panel and said heating element.

15. The blanket of claim 12 further comprising one or more fasteners for fixing said heating element at one or more of said regions.

16. The blanket of claim 15 comprising four fasteners for fixing said heating element, each of said four fasteners fixing said heating element to a corresponding one of said regions.

17. The blanket of claim 12 further comprising a ground fault circuit interrupter hard-wired between the power supply and the blanket.

18. The blanket of claim 12 adapted to thermally respond to a thermostat in thermal communication with an article to be heated.

* * * * *

UNITED STATES PATENT AND TRADEMARK OFFICE

CERTIFICATE OF CORRECTION

PATENT NO. : 9,095,008 B1
APPLICATION NO. : 13/657769
DATED : July 28, 2015
INVENTOR(S) : Seacord et al.

It is certified that error appears in the above-identified patent and that said Letters Patent is hereby corrected as shown below:

In the Specification

Column 3; Line 21; Please delete "c9ontinual" and insert --continual--.

Signed and Sealed this
Thirteenth Day of October, 2015

Michelle K. Lee

Michelle K. Lee
*Director of the United States Patent and Trademark Office*